US006155538A

United States Patent [19]

Winter

[11] Patent Number: 6,155,538

[45] Date of Patent: Dec. 5, 2000

[54] WINCH

[75] Inventor: Klaus-Jürgen Winter, Wetter, Germany

[73] Assignee: Mannesmann AG, Düsseldorf, Germany

[21] Appl. No.: 09/368,039

[22] Filed: Aug. 3, 1999

[30] Foreign Application Priority Data

Aug. 20, 1998 [DE] Germany ..... 198 38 674

[51] Int. Cl.[7] ..... B66D 1/00

[52] U.S. Cl. ..... 254/331; 254/360

[58] Field of Search ..... 254/331, 332, 254/360, 361, 367

[56] References Cited

U.S. PATENT DOCUMENTS

| | | | |
|---|---|---|---|
| 3,260,508 | 7/1966 | Powell | 254/331 |
| 3,286,989 | 11/1966 | Bangerter et al. | 254/331 |
| 3,384,350 | 5/1968 | Powell | 254/331 X |
| 3,428,298 | 2/1969 | Powell | 254/331 |
| 3,526,388 | 9/1970 | Geiger et al. | 254/360 |
| 3,656,715 | 4/1972 | Powell | 254/331 |
| 3,791,627 | 2/1974 | Stone et al. | 254/331 |
| 4,061,311 | 12/1977 | Yamasaki et al. | 254/331 |
| 5,492,306 | 2/1996 | Zaguroli, Jr. | 254/360 X |
| 5,553,832 | 9/1996 | Zaguroli, Jr. | 254/331 X |
| 5,611,522 | 3/1997 | Zaguroli, Jr. | 254/331 |
| 5,848,781 | 12/1998 | Kulhavy et al. | 254/360 |
| 5,915,673 | 6/1999 | Kazerooni | 254/331 X |

FOREIGN PATENT DOCUMENTS

| | | |
|---|---|---|
| 19 28 683 | 12/1969 | Germany . |
| 14 81 878 | 4/1972 | Germany . |

*Primary Examiner*—Donald P. Walsh
*Assistant Examiner*—Emmanuel M. Marcelo
*Attorney, Agent, or Firm*—Henry M. Feireisen

[57] ABSTRACT

A winch, includes a housing which receives therein a rotatable rope drum moveable in a longitudinal direction between two end positions through operation of a gas-actuated piston. A spindle, mounted in fixed rotative engagement to the rope drum and extending in coaxial relationship thereto, carries a nut which is securely fixed to the housing for guiding the spindle in the longitudinal direction. Arranged coaxially between the piston and the rope drum is a pivot bearing which includes two bearing rings arranged side-by-side in a direction of a rotation axis of the pivot bearing, whereby, during operation, an end face of the rope drum rests upon one of the bearing rings, and the piston rests on the other one of the bearing rings. In order to prevent an undesired tilting of the piston in the housing, when the piston is not acted upon by gas pressure, a catch is provided to link the piston and the rope drum so as to restrict an axial displacement of the piston and the rope drum relative to one another to a predetermined value.

11 Claims, 2 Drawing Sheets

WINCH

CROSS-REFERENCES TO RELATED APPLICATIONS

This application claims the priority of German Patent Application, Serial No. 198 38 674.5, filed Aug. 20, 1998.

BACKGROUND OF THE INVENTION

The present invention relates to a winch.

German patent specification DE-AS 1, 481,878 describes a pneumatically operated hoist with automatic weight compensation, including a housing which bounds a working pressure chamber of variable volume. The working chamber is demarcated on one side by a piston which travels longitudinally in the working chamber and forms in conjunction with a spindle and a spindle nut a drive unit for a rope drum. The spindle is guided in longitudinal direction by the spindle nut which is securely fixed to the housing. One end of the spindle is connected to the rope drum in a fixed rotative engagement, with the spindle and the rope drum being disposed in coaxial relationship. Operation of the rope drum is realized through a build-up of gas pressure in the working chamber so that the piston is pushed against an end face of the rope drum, thereby displacing the rope drum along the spindle and as a consequence causing a conjoint rotation of the spindle and the rope drum. A rotation of the piston as a result of the rotational movement of the rope drum is prevented by a coaxial disposition of a pivot bearing between the piston and the rope drum. The pivot bearing includes two bearing rings in side-by-side disposition in direction of the rotation axis, wherein during operation, one bearing ring rests on the end face of the rope drum and the other bearing ring rests on the piston.

This conventional hoist suffers the drawback that during transport of the hoist or at pressure drop during operation, i.e. when no gas pressure is encountered in the working chamber, the piston tilts in the pressure chamber. As a consequence, the sealing action is compromised so that the winch becomes useless. This defect can only be rectified through dismantling of the hoist.

SUMMARY OF THE INVENTION

It is thus an object of the present invention to provide an improved winch, obviating the afore-stated drawbacks.

In particular, it is an object of the present invention to provide an improved winch which is so configured as to prevent a misalignment or tilting of the piston in the working chamber when no gas pressure is prevalent in the working chamber.

These objects, and others which will become apparent hereinafter, are attained in accordance with the present invention by providing a catch between the piston and the rope drum to thereby limit a relative displacement in axial direction of the piston and the rope drum relative to one another to a predetermined value.

The disposition of a catch between the piston and the rope drum ensures that the piston and the rope drum can shift in axial direction relative to one another only in a predetermined range in the event no gas pressure prevails in the working chamber to act on the piston. An excessive displacement and thus a tilting of the piston is prevented by the catch which maintains the axial distance between the piston and the rope drum constant once the limit of relative axial displacement between the piston and the rope drum is reached.

A uniform conjoint movement of the piston by the rope drum, and vice versa, can be realized by configuring the catch in a ring-shaped manner.

According to another feature of the present invention, the catch has one end secured to the piston, thereby realizing a stable limitation of the axial distancing between the piston and the rope drum. Suitably, the axial displacement can be limited by forming the catch with a restraining element which engages with clearance in an indentation of the rope drum. A simple embodiment involves the configuration of the restraining element in the form of an annular projection, e.g. a collar, which engages in a radial groove of the rope drum.

According to another aspect of the present invention, the pivot bearing is received in a complementary recess of the piston and axially secured on the piston. Thus, when the piston bears with an end face on the rope drum, no torque is transmitted between the piston and the rope drum.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
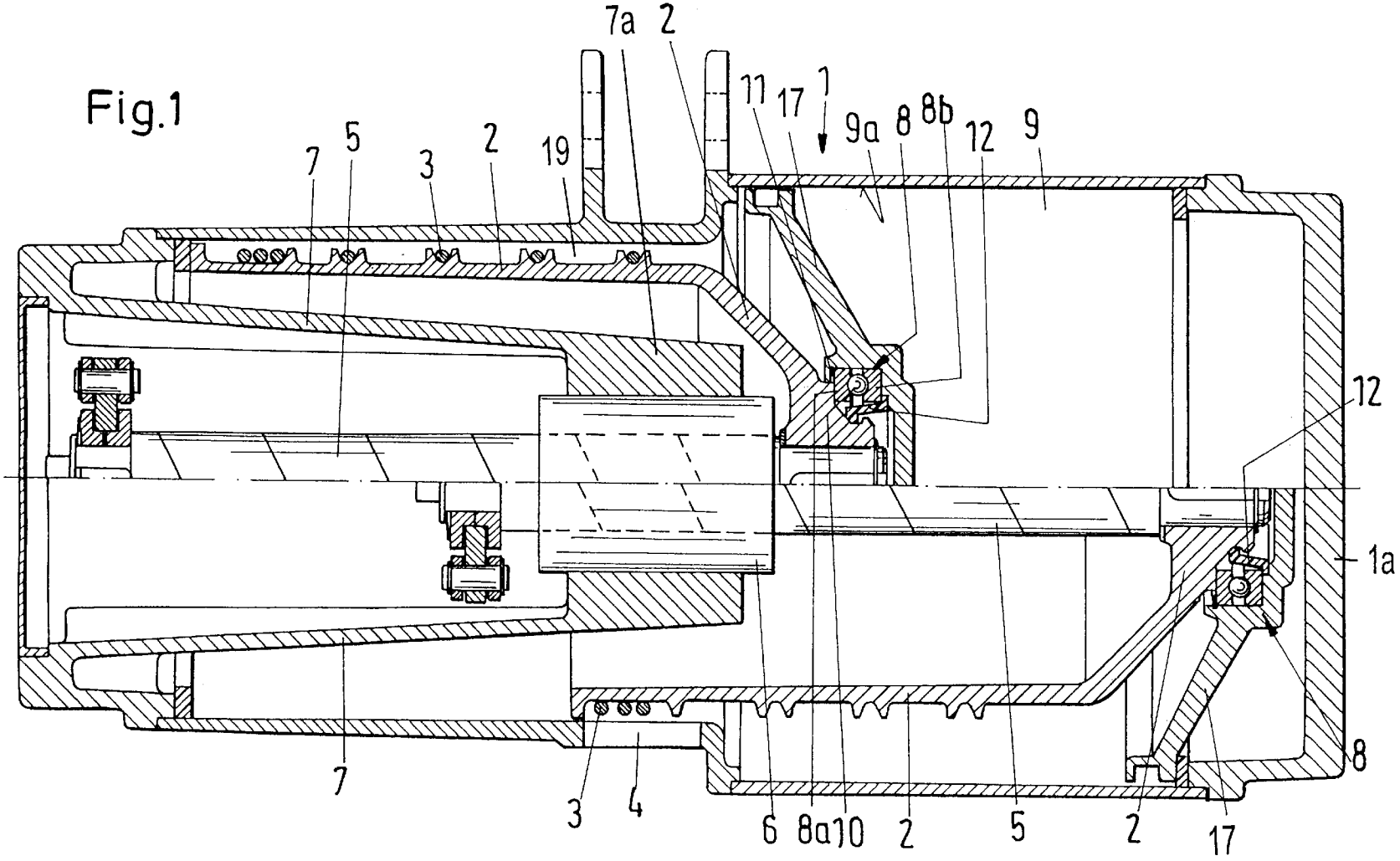
FIG. 1 is a longitudinal section of a winch according to the present invention, with the upper half illustrating the rope drum and the piston in one end position, and with the lower half illustrating the rope drum and the piston in the other end position.

Throughout all the Figures, same or corresponding elements are generally indicated by same reference numerals.

Turning now to the drawing, and in particular to FIG. 1, there is shown a longitudinal section of a winch according to the present invention, including a housing 1 which is composed of several housing parts to form an interior space 19. Rotatably supported in the interior space 19 of the housing 1 is a rope drum 2 which has an outer surface on which a rope 3 is wound, with one end of the rope 3 being secured to the rope drum 2 and the other end of the rope 3 being guided to the outside through a housing opening 4 and adapted for carrying a load (not shown). The rope drum 2 interacts with a spindle assembly, comprised of a spindle 5 and a spindle nut 6, for travel inside the housing 1 in longitudinal direction between two end positions during rotational movement, such that the rope 3 exits the housing 1 substantially at the same location. In FIG. 1, the upper half of the illustration shows the rope drum 2 in one end position, i.e. the left end position, while the lower half shows the rope drum 2 in the other end position, i.e. the right end position.

The housing 1 is formed interiorly with a hollow cone 7 which projects inwardly from one axial end of the housing 1 and terminates in a support member 7*a* for mounting therein the spindle nut 6 in fixed rotative engagement, so that the spindle nut 6 is securely fixed to the housing 1. Traversing the spindle nut 6 in longitudinal direction is the spindle 5, with the rope drum 2 having one end securely mounted to the spindle 5. Thus, a rotation of the rope drum 2 is realized through displacement of the coaxial spindle 5, thereby effecting, at the same time, a displacement of the rope drum 2 in longitudinal direction within the housing 1.

Actuation of the spindle assembly and thus displacement of the rope drum 2 is realized by a drive which includes a cylindrical piston 17 extending coaxially to the spindle assembly and received in a pressure compartment 9, which is bounded between an end wall 1*a* of the housing 1 and a confronting end face of the rope drum 2. Thus, through introduction of gas under pressure into the pressure compartment 9 in dependence on the load carried by the rope 3 of the rope drum 2, the piston 17 is able to travel in longitudinal direction. Although not shown in detail, sealing elements are disposed at the interface between the piston 17 and the inside surface 9*a* of the pressure compartment 9.

At operation, gas enters the pressure compartment 9 in dependence on the load being carried, thereby urging the piston 17 to the left so that the rope drum 2 and the spindle 5 are also pushed to the left. As a consequence of the immobility of the spindle nut 6 and the fixed rotative engagement between the spindle 5 and the rope drum 2, the rope drum 2 rotates at the same time to thereby wind up the rope 3 and to lift the load.

The piston 17 is supported by a pivot bearing, generally designated by reference numeral 8 and positioned between the rope drum 2 and the piston 17. The pivot bearing 8 includes two bearing rings 8*a*, 8*b* in side-by-side disposition in the direction of the rotation axis of the pivot bearing 8, whereby, during operation, an end face of the rope drum 2 rests against the bearing ring 8*a*, and the piston 17 rests against the other bearing ring 8*b*. The pivot bearing 8 is received on the rope drum confronting side of the piston 17 in a respective recess 20 which complements the outer contour of the pivot bearing 8. As shown in particular in FIG. 2, which illustrates, on an enlarged scale, the area of the pivot bearing 8, it can be seen that the bearing ring 8*b* rests in the recess 20 upon the piston 17 while the other bearing ring 8*a* is freely rotatably supported via balls 10 which are retained in a cage 21. A retainer ring 11 ensures securement of the pivot bearing 8 in axial direction.

Figure 2:
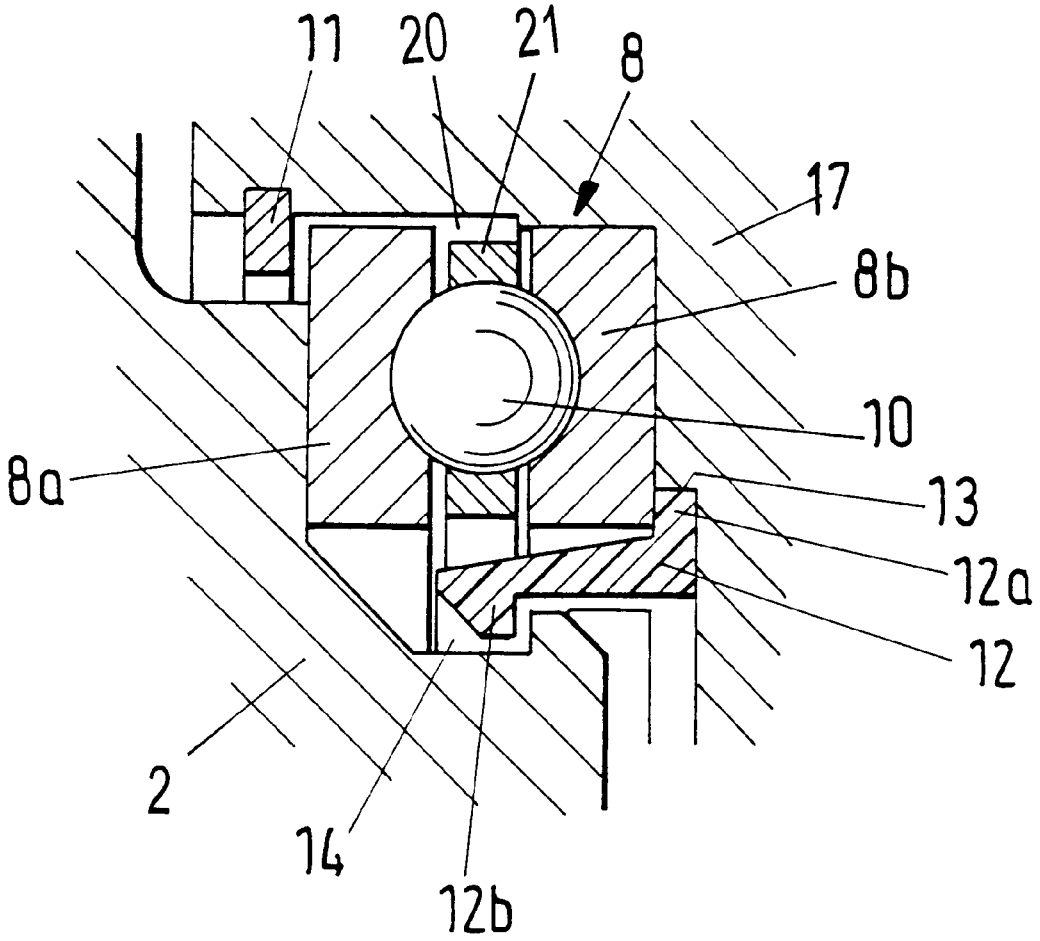
FIG. 2 is a cutaway view of the winch on an enlarged scale, showing in detail the area of the catch.

As further seen in FIGS. 1 and 2, the piston 17 and the rope drum 2 can be linked to one another by a coupling member or catch 12 of ring-shaped configuration. The catch 12 is formed on one end with a mounting flange 12*a* which extends radially outwards and is fixed in a groove 13 formed in the recess 20 and bounded by the piston 17 and the bearing ring 8*b* of the pivot bearing 8. At the other end thereof, the catch 12 is formed with a radially inwardly directed restraining element in the form of a collar 12*b* which engages, with play, a radial groove 14 of the rope drum 2 so as to limit a possible axial displacement of the piston 17 and the rope drum 2 relative to one another, with the axial length of the groove 14 being determinative for the range of the permissible axial displacement. Thus, through the provision of the projecting collar 12*b*, the piston 17 and the rope drum 2 are securely linked to one another so that, at unexpected pressure drop in the pressure compartment 9 or during transport of the winch, the piston 17 is prevented from tilting as a result of the limited axial displacement of the piston 17 and the rope drum 2 relative to one another because the angle of tilt of the piston 17 can no longer exceed the maximum permissible value.

While the invention has been illustrated and described as embodied in a winch, it is not intended to be limited to the details shown since various modifications and structural changes may be made without departing in any way from the spirit of the present invention.

What is claimed as new and desired to be protected by Letters Patent is set forth in the appended claims:

1. A winch, comprising:

a housing;

a rope drum rotatably supported in the housing and moveable in a longitudinal direction between two end positions;

a piston operated by gas pressure for moving the rope drum between the end positions;

a spindle mounted in fixed rotative engagement to the rope drum and extending in coaxial relationship thereto, said spindle carrying a nut which is securely fixed to the housing for guiding the spindle in the longitudinal direction;

a pivot bearing arranged coaxially between the piston and the rope drum and including two bearing rings arranged side-by-side in a direction of a rotation axis of the pivot bearing, whereby during operation an end face of the rope drum rests upon one of the bearing rings and the piston rests on the other one of the bearing rings; and a catch, provided between the piston and the rope drum, for limiting an axial displacement of the piston and the rope drum relative to one another to a predetermined value.

2. The winch of claim 1 wherein the catch has a ring-shaped configuration.

3. The winch of claim 1 wherein the catch is secured to the piston.

4. The winch of claim 1 wherein the catch has at least one restraining element for engagement with clearance in an indentation of the rope drum.

5. The winch of claim 4 wherein the indentation of the rope drum is a radial groove, said restraining element being formed with an outwardly directed collar for engagement in the radial groove.

6. The winch of claim 1 wherein the piston includes a recess complementing a contour of the pivot bearing, said pivot bearing being received in the recess.

7. The winch of claim 6, and further comprising a safety means for securing the pivot bearing in an axial direction on the piston.

8. A winch, comprising:

a rope drum for winding and unwinding a rope;

a drive unit for rotating the rope drum while moving the rope drum in a longitudinal direction, said drive unit including a piston operated by gas pressure and acting upon the rope drum via a pivot bearing positioned between the piston and the rope drum; and a catch for coupling the piston and the rope drum to limit an axial displacement of the piston and the rope drum relative to one another, thereby preventing a misalignment of the piston when no gas pressure is applied upon the piston, said catch having one end in the form of an outwardly directed collar for engagement in a radial groove of the rope drum.

9. The winch of claim 8 wherein the catch has a ring-shaped configuration.

10. The winch of claim 8 wherein the catch has one end formed as a mounting flange for secure attachment to the piston.

11. The winch of claim 8 wherein the groove has an axial length which exceeds an axial extension of the collar, thereby establishing a latitude for axial displacement between the piston and the rope drum.

* * * * *